US012134854B2

(12) United States Patent
Obregon et al.

(10) Patent No.: US 12,134,854 B2
(45) Date of Patent: Nov. 5, 2024

(54) DRYER APPLIANCE AND METHODS FOR DETECTING VENT OBSTRUCTION

(71) Applicant: Haier US Appliance Solutions, Inc., Wilmington, DE (US)

(72) Inventors: Roberto Obregon, Louisville, KY (US); Nemetalla Salameh, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 557 days.

(21) Appl. No.: 17/501,166

(22) Filed: Oct. 14, 2021

(65) Prior Publication Data

US 2023/0123910 A1 Apr. 20, 2023

(51) Int. Cl.

| | |
|---|---|
| ***D06F 58/38*** | (2020.01) |
| ***D06F 58/26*** | (2006.01) |
| ***D06F 103/32*** | (2020.01) |
| ***D06F 105/20*** | (2020.01) |
| ***D06F 105/28*** | (2020.01) |

(52) U.S. Cl.

CPC ..... *D06F 58/38* (2020.02); *D06F 58/26* (2013.01); *D06F 2103/32* (2020.02); *D06F 2105/20* (2020.02); *D06F 2105/28* (2020.02)

(58) Field of Classification Search

CPC ..... D06F 58/38; D06F 58/26; D06F 2103/32; D06F 2105/20; D06F 2105/28; D06F 58/02; D06F 2103/38; D06F 2105/54; D06F 2105/58; D06F 58/50

See application file for complete search history.

(56) References Cited

U.S. PATENT DOCUMENTS

| | | | |
|---|---|---|---|
| 6,792,694 | B2 | 9/2004 | Lapierre |
| 7,926,201 | B2 | 4/2011 | Kim |
| 9,435,587 | B2 | 9/2016 | Lee |

(Continued)

FOREIGN PATENT DOCUMENTS

| | | | |
|---|---|---|---|
| CN | 102154805 A | * | 8/2011 |
| CN | 102154805 B | | 6/2016 |
| KR | 100651864 B1 | | 12/2006 |

OTHER PUBLICATIONS

Translation, CN-102154805-A (Year: 2011).*

*Primary Examiner* — Jessica Yuen
(74) *Attorney, Agent, or Firm* — Dority & Manning, P.A.

(57) ABSTRACT

A dryer appliance may include a cabinet, a drum, a heater assembly, a temperature sensor, and a controller. The heater assembly may be in upstream fluid communication with a drying chamber. The temperature sensor may be in upstream fluid communication with the drying chamber. The controller may be in operable communication with the heater assembly and the temperature sensor. The controller may be configured to initiate a test cycle. The test cycle may include activating the heater assembly, detecting a first temperature upstream of the drum at a first moment following activating the heater assembly, detecting a second temperature upstream of the drum at a second moment following the first moment, determining a temperature delta as a difference between the second temperature and the first temperature, comparing the temperature delta to a delta threshold, and initiating an alert message based on comparing the temperature delta to the delta threshold.

20 Claims, 6 Drawing Sheets

(56) References Cited

U.S. PATENT DOCUMENTS

| | | | | |
|---|---|---|---|---|
| 2013/0255101 | A1 | 10/2013 | Lee | |
| 2015/0020398 | A1* | 1/2015 | Bae | D06F 58/20 34/80 |

* cited by examiner

DRYER APPLIANCE AND METHODS FOR DETECTING VENT OBSTRUCTION

FIELD OF THE INVENTION

The present subject matter relates generally to dryer appliances, and more particularly to features and methods for detecting vent obstructions.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, a blower is utilized to flow the internal air from the vent duct to the exhaust duct. When operating the blower may pull air through itself from the vent duct, and this air may then flow from the blower to the exhaust conduit.

One issue that exists with dryer appliances is the possibility of restrictions in, for example, the vent duct or exhaust conduit. Restrictions decrease the effective operating size of the passages through which air flows during operation, and can be caused by, for example, lint build-up or other impediments lodged in such passages. Restrictions can prevent proper airflow, thereby increasing drying cycle time, reducing drying power efficiency, or reducing drying of articles in the dryer appliances. In some cases, restrictions can cause damage to dryer appliances, such as by unsuitable heat. Accordingly, the ability to diagnose restrictions is of upmost importance.

Attempts have been made to diagnose restrictions in dryer appliances. For example, attempts have been made to measure pressure differentials in the exhaust conduit and other various dryer appliance locations. Additionally, attempts have been made to use (e.g., exclusively) calibrated electromechanical thermostats to cut power at a single temperature threshold during operation of the dryer appliance. These attempts typically prove to be costly or ineffective. Moreover, such attempts generally require diagnosing or addressing restrictions during a drying cycle, which often occurs when a technician is not present or when a consumer is already using the dryer appliance. Accordingly, improved dryer appliances and methods for diagnosing restrictions in dryer appliances are desired.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance may include a cabinet, a drum, a heater assembly, a temperature sensor, and a controller. The drum may be mounted within the cabinet. The drum may define a drying chamber. The heater assembly may be in upstream fluid communication with the drying chamber to heat air thereto. The temperature sensor may be in upstream fluid communication with the drying chamber to detect a temperature of air thereto. The controller may be in operable communication with the heater assembly and the temperature sensor. The controller may be configured to initiate a test cycle. The test cycle may include activating the heater assembly, detecting a first temperature upstream of the drum at a first moment following activating the heater assembly, detecting a second temperature upstream of the drum at a second moment following the first moment, determining a temperature delta as a difference between the second temperature and the first temperature, comparing the temperature delta to a delta threshold, and initiating an alert message based on comparing the temperature delta to the delta threshold.

In another exemplary aspect of the present disclosure, a method of operating a dryer appliance is provided. The method may include activating a heater assembly and detecting a first temperature upstream of the drum at a first moment following activating the heater assembly. The method may further include detecting a second temperature upstream of the drum at a second moment following the first moment, determining a temperature delta as a difference between the second temperature and the first temperature, and comparing the temperature delta to a delta threshold. The method may still further include initiating an alert message based on comparing the temperature delta to the delta threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
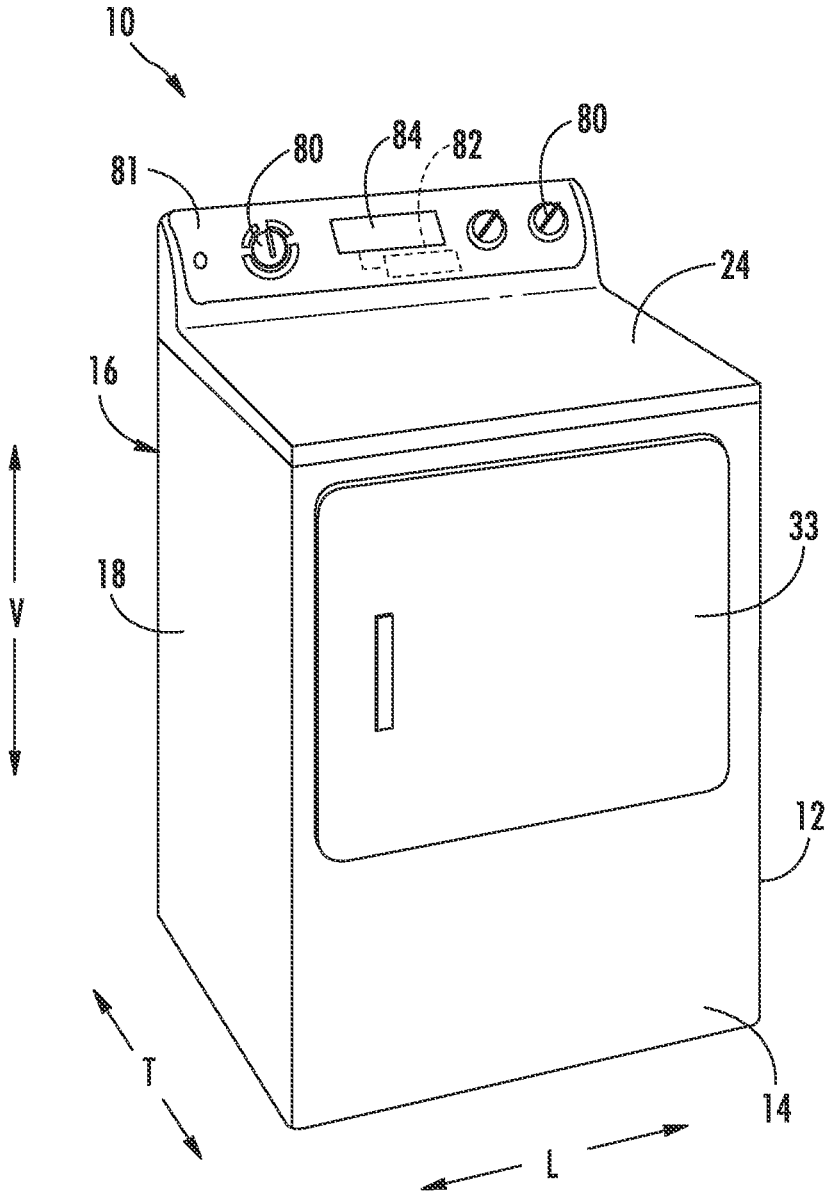
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Figure 2:
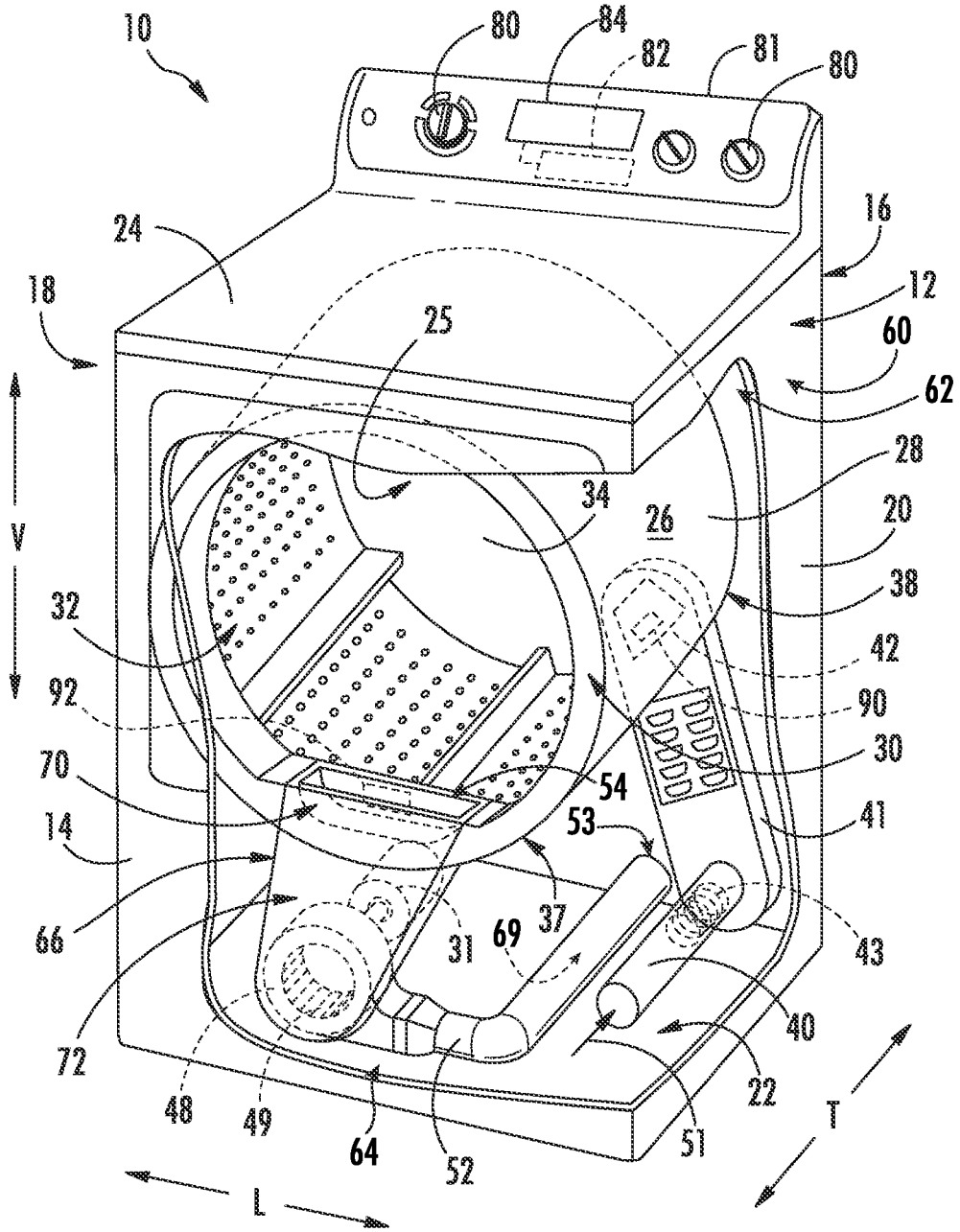
FIG. 2 provides a perspective view of the exemplary dryer appliance of FIG. 1, with portions of a cabinet of the dryer appliance removed to reveal certain components of the dryer appliance.
Figure 3:
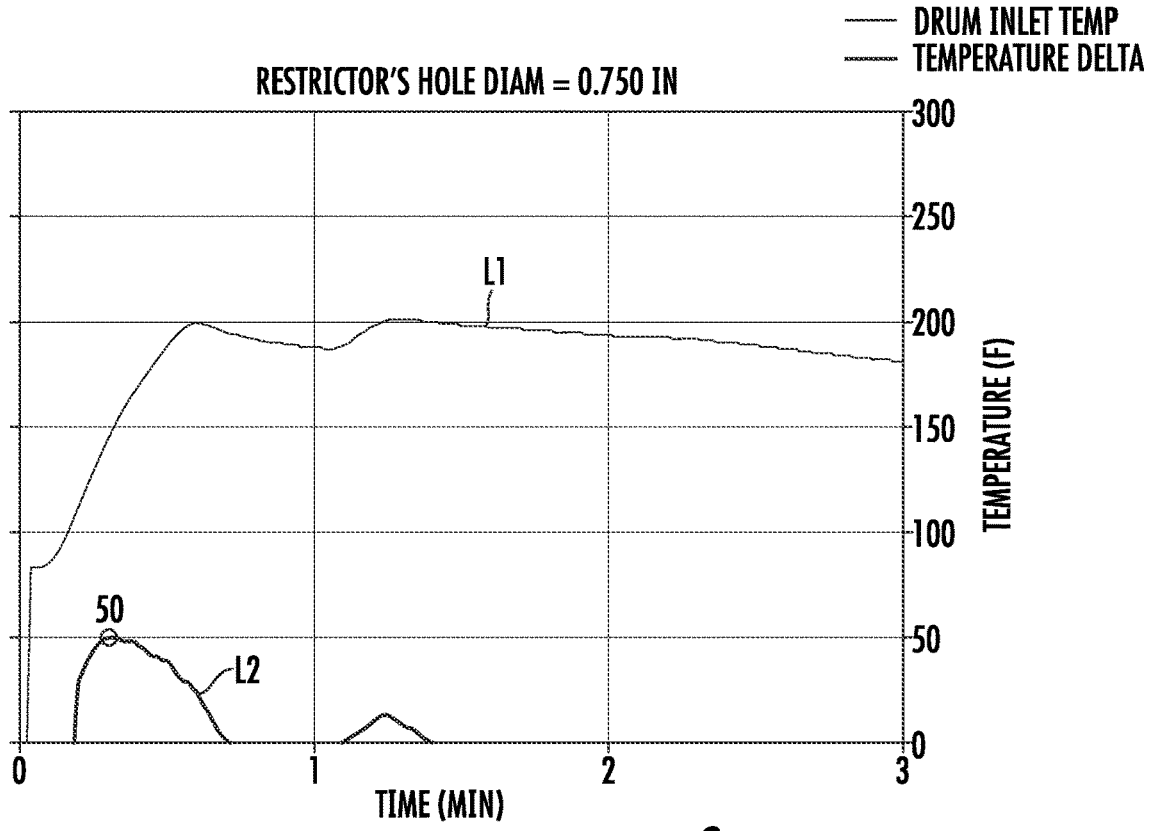
FIG. 3 provides a graph illustrating testing data related to temperature changes over time for a first restriction.
Figure 4:
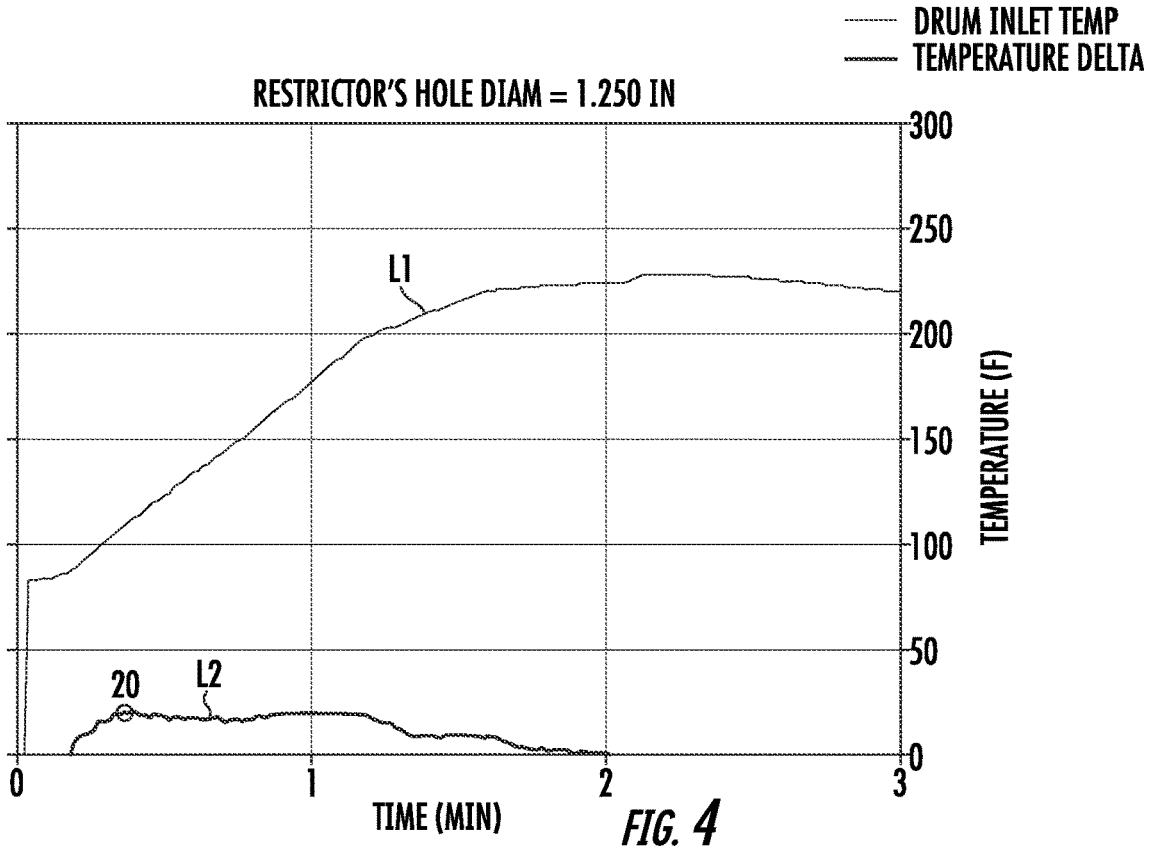
FIG. 4 illustrates a graph illustrating testing data related to temperature changes over time for a second restriction.
Figure 5:
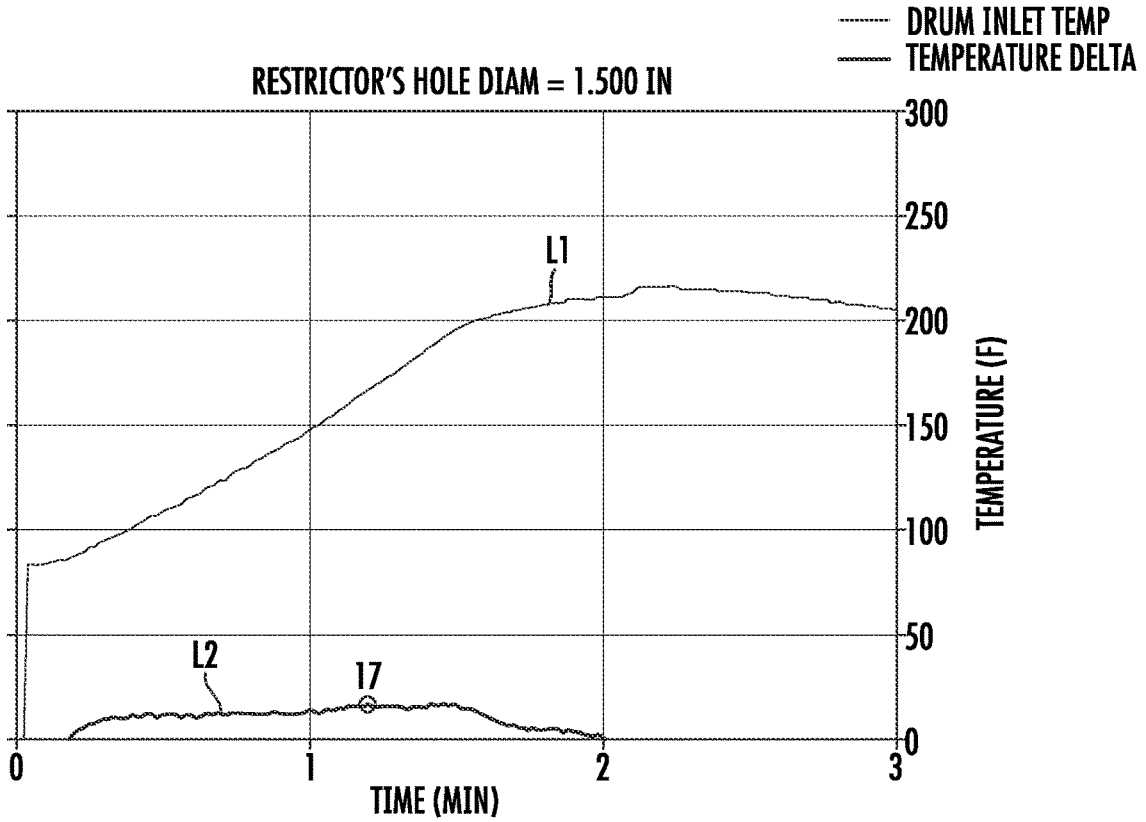
FIG. 5 provides a graph illustrating testing data related to temperature changes over time for a third restriction.
Figure 6:
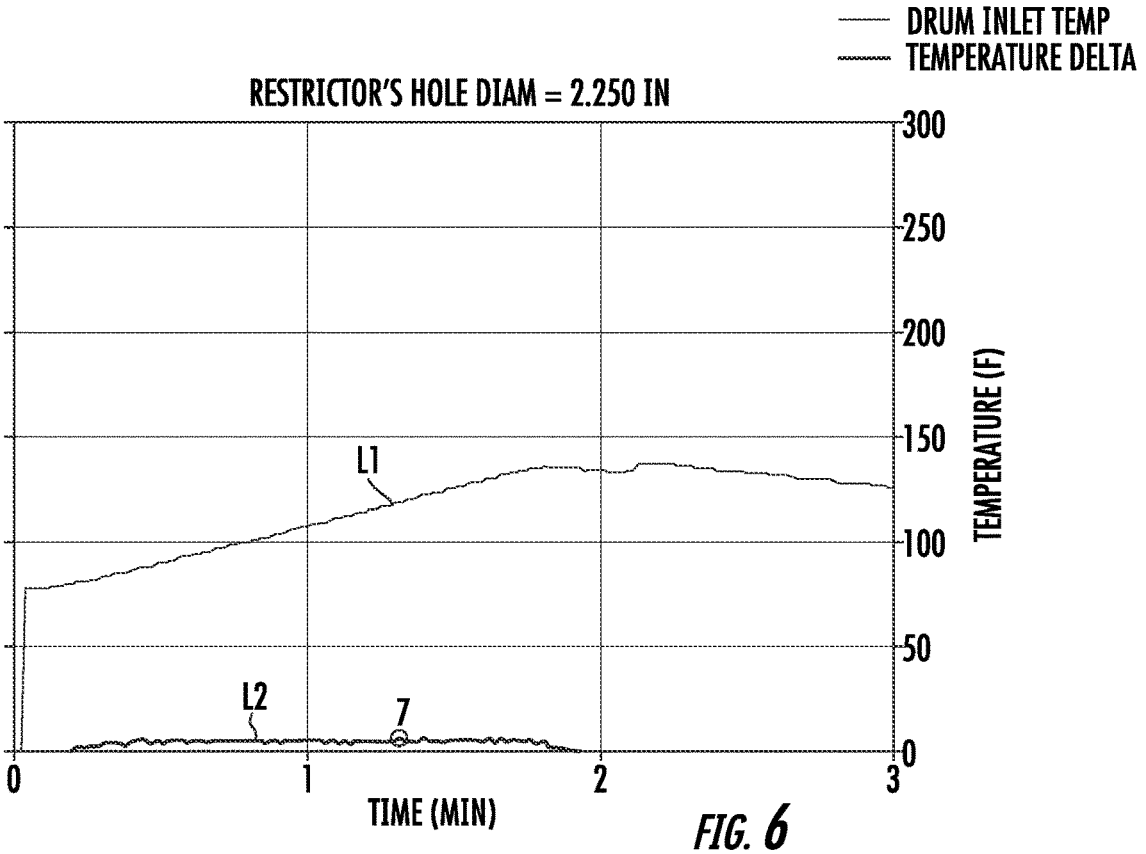
FIG. 6 provides a graph illustrating testing data related to temperature changes over time for a fourth restriction.
Figure 7:
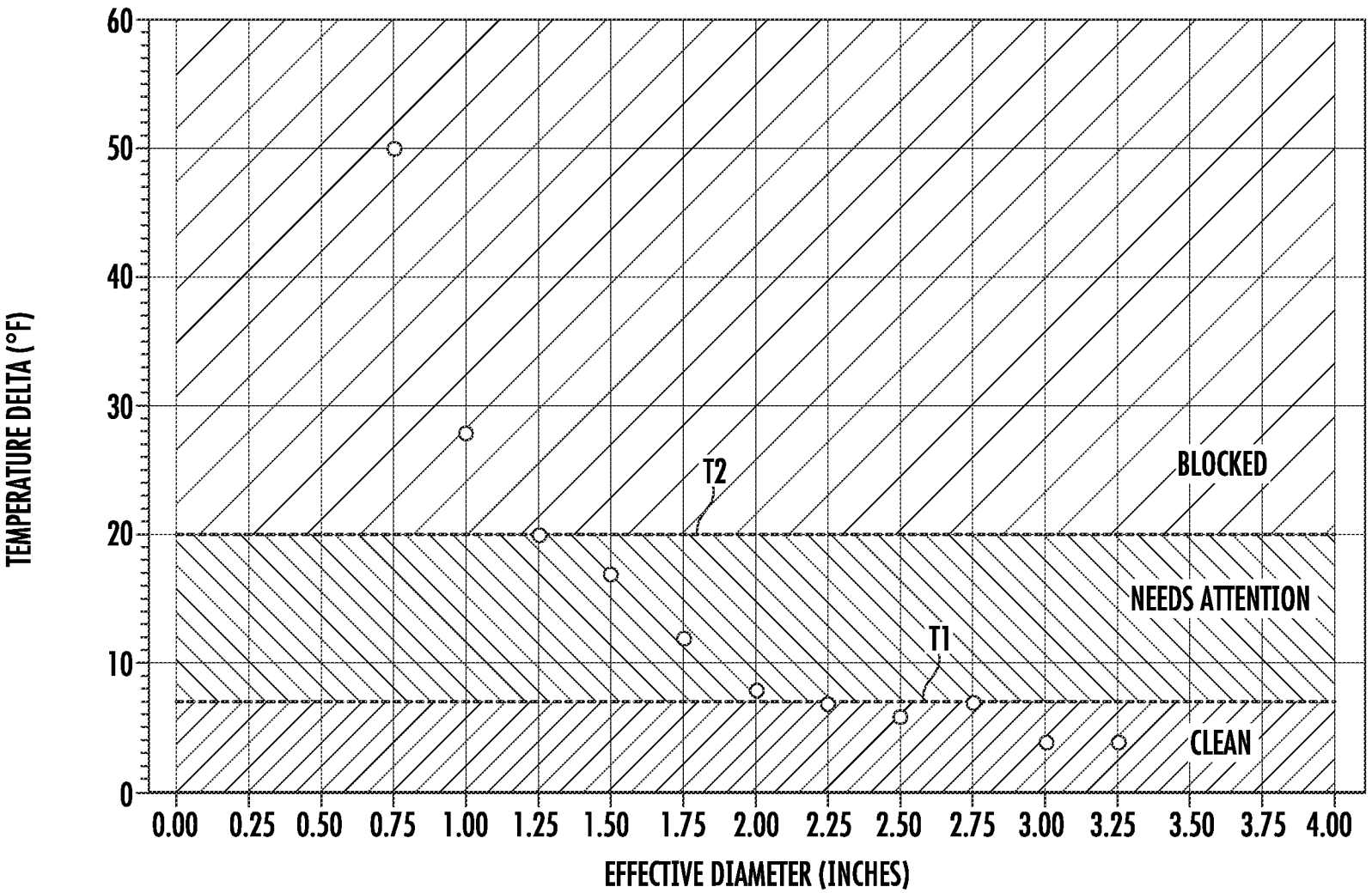
FIG. 7 provides a graph illustrating testing data related to temperature deltas relative to multiple restrictions altering the effective diameter of a ventilation conduit.

Turning now to the figures, FIG. 1 illustrates a dryer appliance 10 according to exemplary embodiments of the present disclosure. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances 10 having different appearances and different features may also be utilized with the present subject matter as well.

Generally, dryer appliance 10 defines a vertical direction V, a lateral direction L, and a transverse direction T. The vertical direction V, lateral direction L, and transverse direction T are mutually perpendicular and form and orthogonal direction system. Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of cabinet 12 and an interior 62 of cabinet 12. Within interior 62 of cabinet 12 is a drum or container 26. Drum 26 defines a chamber 25 for receipt of articles (e.g., clothing, linen, etc.) for drying. Drum 26 extends between a front portion 37 and a back portion 38 (e.g., along the transverse direction T). In exemplary embodiments, drum 26 is rotatable, for instance, about an axis that is parallel to the transverse direction T, within cabinet 12.

A blower motor 31 may be in mechanical communication with an air handler or blower assembly (e.g., blower 48). During certain operations, motor 31 may rotate a blower fan or impeller 49 of blower 48. Blower 48 is configured for drawing air through chamber 25 of drum 26 (e.g., in order to dry articles located therein), as discussed in greater detail below. Optionally, dryer appliance 10 may include an additional motor (e.g., drum motor—not pictured) in mechanical communication with drum 26, as would be understood. In such embodiments, the drum motor can rotate drum independently of blower 48.

Drum 26 may be configured to receive heated air that has been heated by a heater assembly 40 (e.g., in order to dry damp articles disposed within chamber 25 of drum 26). Heater assembly 40 includes a heater 43, such as a gas burner or one or more electrical resistance heating elements, for heating air. As discussed above, during operation of dryer appliance 10, motor 31 rotates impeller 49 of blower 48 such that blower 48 draws air through chamber 25 of drum 26. In particular, ambient air enters heater assembly 40 via an entrance (e.g., as indicated at arrow 51) due to blower 48 urging such ambient air into entrance. Such ambient air is heated within heater assembly 40 and exits heater assembly 40 as heated air. Blower 48 draws such heated air through inlet duct 41 to drum 26. The heated air enters drum 26 through an outlet 42 of duct 41. Outlet 42 may be positioned at rear wall 34 of drum 26.

Within chamber 25, the heated air can remove moisture (e.g., from damp articles disposed within chamber 25). This internal air, in turn, flows from chamber 25 through a ventilation assembly 64 positioned within interior 62. Generally, ventilation assembly 64 includes an exhaust conduit 52 that defines an exhaust passage 69. Exhaust passage 69 is in fluid communication with the drying chamber 25 and extends from an inlet 54 at drying chamber 25 to an outlet 53 defined by cabinet 12. In some embodiments, the exhaust conduit 52 includes a vent duct 66, blower 48, and a ducted conduit 68. As shown, exhaust conduit 52 may be configured in fluid communication with vent duct 66 via blower 48. During a dry cycle, internal air flows from chamber 25 through vent duct 66 to blower 48 and through blower 48 to exhaust conduit 52. The internal air is then exhausted from dryer appliance 10 via the outlet 53.

In exemplary embodiments, vent duct 66 may include a filter portion 70 and an exhaust portion 72. Exhaust portion 72 may be positioned downstream of filter portion 70 (in the direction of flow of the internal air). A screen filter of filter portion 70 (which may be removable) traps lint and other foreign materials as the internal air flows therethrough. The internal air may then flow through exhaust portion 72 and blower 48 to ducted conduit 68 and, subsequently, an external duct (not shown). After the clothing articles have been dried, the clothing articles are removed from drum 26 via entry 32. A door 33 provides for closing or accessing drum 26 through entry 32.

A user interface or control panel having one or more selector inputs 80, such as knobs, buttons, touchscreen interfaces, etc., may be provided on a cabinet backsplash 81 and in communication with a processing device or controller 82. Signals generated in controller 82 operate one or more motors (e.g., motor 31 or a drum motor) and heater assembly 40 (including heater 43) in response to the position of selector inputs 80. Additionally, a display 84 of the control panel, such as an indicator light or a screen, may be provided on cabinet backsplash 81. Display 84 may be in communication with controller 82, and may display information in response to signals from controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitive storage media) such as, for example, electrically erasable, programmable read only memory (EEPROM). The memory elements can store information accessible processing device, including instructions that can be executed by processing device. For example, the instructions can be software or any set of instructions that when executed by the processing device, cause the processing device to perform operations. For certain embodiments, the instructions include a software package configured to operate appliance 10 and, for instance, execute the exemplary method 800 described below with reference to FIGS. 8.

In some embodiments, dryer appliance 10 includes one or more temperature sensors (e.g., temperature sensor 90). Temperature sensor 90 is operable to measure internal temperatures in dryer appliance 10. In particular, temperature sensor 90 may be provided as any suitable temperature sensor (e.g., thermistor, thermocouple, etc.) in communication (e.g., electrical communication or wireless communication) with controller 82, and may transmit readings or signals to controller 82 as required or desired. In some embodiments, for example, temperature sensor 90 may be disposed in inlet duct 41, such as at outlet 42 of inlet duct 41, which corresponds to an inlet to drum 26. Additionally or alternatively, for example, a temperature sensor 90 may be disposed in drum 26, such as in chamber 25 thereof, at an outlet of drum 26 such as in vent duct 66, or in any other suitable location within dryer appliance 10.

During certain operations, such as a test cycle, a temperature sensor 90 (e.g., a single temperature sensor) may measure a separate first temperature and second temperature within to or upstream from drum 26. Optionally, more temperatures (e.g., a third temperature) may also be measured (e.g., at the same temperature sensor). As used within the present disclosure, "first temperature," "second temperature," or "third temperature" are used in order to distinguish a temporal relationship (as opposed to a positional relationship). Thus, the first, second, or third temperature may be distinguished by a delineating occurrence or action (e.g., separated by one or more set delay periods). For instance, the first temperature may be understood to indicate a temperature at a first moment, while second or third temperatures may be understood to indicate a subsequent or later temperature (e.g., at the same location) taken at a second or third moment, respectively. Optionally the first moment may be separated from the second moment by the set delay period. Additionally or alternatively, the second moment may be separated from the third moment by the set delay period.

In some such embodiments, the appliance 10 or controller 82 includes a test operation or cycle (e.g., separate or independent of a drying operation or cycle) in which the controller 82 can continue to collect additional temperature measurements from the temperature sensor 90 (e.g., at a set rate corresponding to the set delay period). Such additional temperature measurements (i.e., detection of temperatures) may continue, for instance, until the expiration of a predetermined test period (e.g., which begins in response to a user input indicating an obstruction test operation. As temperature measurements are collected, controller 82 may determine a temperature delta (i.e., difference in temperature) between adjacent temperature measurements, such as between the first temperature and the second temperature or between the second temperature and the third temperature. Optionally, multiple temperature deltas may be determined and recorded (e.g., temporarily) for comparison with one or more delta thresholds, which may be predetermined or programmed within controller 82 (e.g., based on testing data or predictions for the appliance 10). Further optionally, as temperature measurements are collected, multiple temperature deltas may be filtered. For instance, controller 82 may compare separate temperature deltas to identify the maximum temperature delta (i.e., peak delta) across a given period (e.g., the predetermined test period).

Turning briefly to FIGS. 3 through 7, various graphs are provided to illustrate testing data collected for an exemplary dryer appliance (e.g., a representative unit of appliance 10) in which set restrictive conditions varied the effective hole diameter of a ventilation conduit (e.g., as or in downstream communication with exhaust conduit 52). In particular, FIGS. 3 through 6 illustrate multiple temperature measurements (graphed on line L2) and corresponding temperature deltas (graphed on line L2) over time (e.g., a predetermined testing period). Throughout the test period, a heater assembly 40 or blower assembly 48 may be activated. Optionally, heat or power output for the heater or blower assemblies 40 or 48 is constant. In the illustrated examples, the predetermined testing period is two minutes. Nonetheless, it is understood that any suitable period of time may be used (e.g., greater than or equal to thirty seconds or less than or equal to ten minutes). In the illustrated example of FIG. 3, an effective diameter of 0.75 inches resulted in a peak delta of 50° Fahrenheit. In the illustrated example of FIG. 4, an effective diameter of 1.25 inches resulted in a peak delta of 20° Fahrenheit. In the illustrated example of FIG. 5, an effective diameter of 1.50 inches resulted in a peak delta of 17° Fahrenheit. In the illustrated example of FIG. 6, an effective diameter of 2.25 inches resulted in a peak delta of 7° Fahrenheit. As further shown in FIG. 7, which illustrates various peak deltas relative to the effective diameter, a temperature delta (e.g., peak delta) may generally decrease as effective diameter increases. Moreover, one or more thresholds, such as T1 and T2, may be provided to predict if a ventilation conduit is unsuitably blocked (e.g., the relatively high T2) or is at risk for being blocked (e.g., the relatively low T1). In response to a determined temperature delta equaling or exceeding one or more thresholds, controller 82 direct responsive action, such as by displaying an alert (e.g., message or signal at the control panel) or altering heat or power output at the heater assembly 40 or blower assembly. Optionally, heat output may be reduced in response to a threshold being met or exceeded (e.g., by deactivating one or more heating elements or reducing fuel to the heater assembly 40).

Returning generally to FIGS. 1 and 2, in some embodiments, dryer appliance 10 includes one or more dampness or moisture sensors (e.g., moisture sensor 92). Moisture sensor 92 is operable to measure the dampness or moisture content of articles within chamber 25 during operation of dryer appliance 10. In particular, moisture sensor 92 may be provided as any suitable moisture sensor (e.g., capacitive moisture sensor, resistive moisture sensor, etc.) in communication (e.g., electrical communication or wireless communication) with controller 82, and may transmit readings or signals to controller 82 as required or desired. Moisture sensor 92 may measure voltages associated with dampness or moisture content within the clothing, as is generally understood. In FIG. 2, moisture sensor 92 is shown disposed on wall 30 proximate filter portion 70. In alternative exemplary embodiments, moisture sensor 92 may be disposed at any other suitable location within dryer appliance 10 (e.g., on cylinder 28, rear wall 34, etc.). Moisture sensor 92 may be any suitable moisture sensor (e.g., in communication with controller 82), and may transmit readings to controller 82 as required or desired.

In further additional or alternative embodiments, dryer appliance 10 includes one or more flow sensors (e.g., flow sensor 94). Flow sensor 94 is generally operable to measure airflow velocity (e.g., in feet per minute) through a portion of appliance 10, such as ventilation assembly 64. In particular, flow sensor 94 may be provided as any suitable flow sensor 94 (e.g., mechanical flow meter, pressure-based meter, optical meter, etc.) in communication (e.g., electrical communication or wireless communication) with controller 82, and may transmit readings or signals to controller 82 as required or desired. In certain embodiments, flow sensor 94 is disposed in exhaust conduit 52 (e.g., along exhaust passage 69). Additionally or alternatively, flow sensor(s) may be disposed in any other suitable location within dryer appliance 10.

Figure 8:
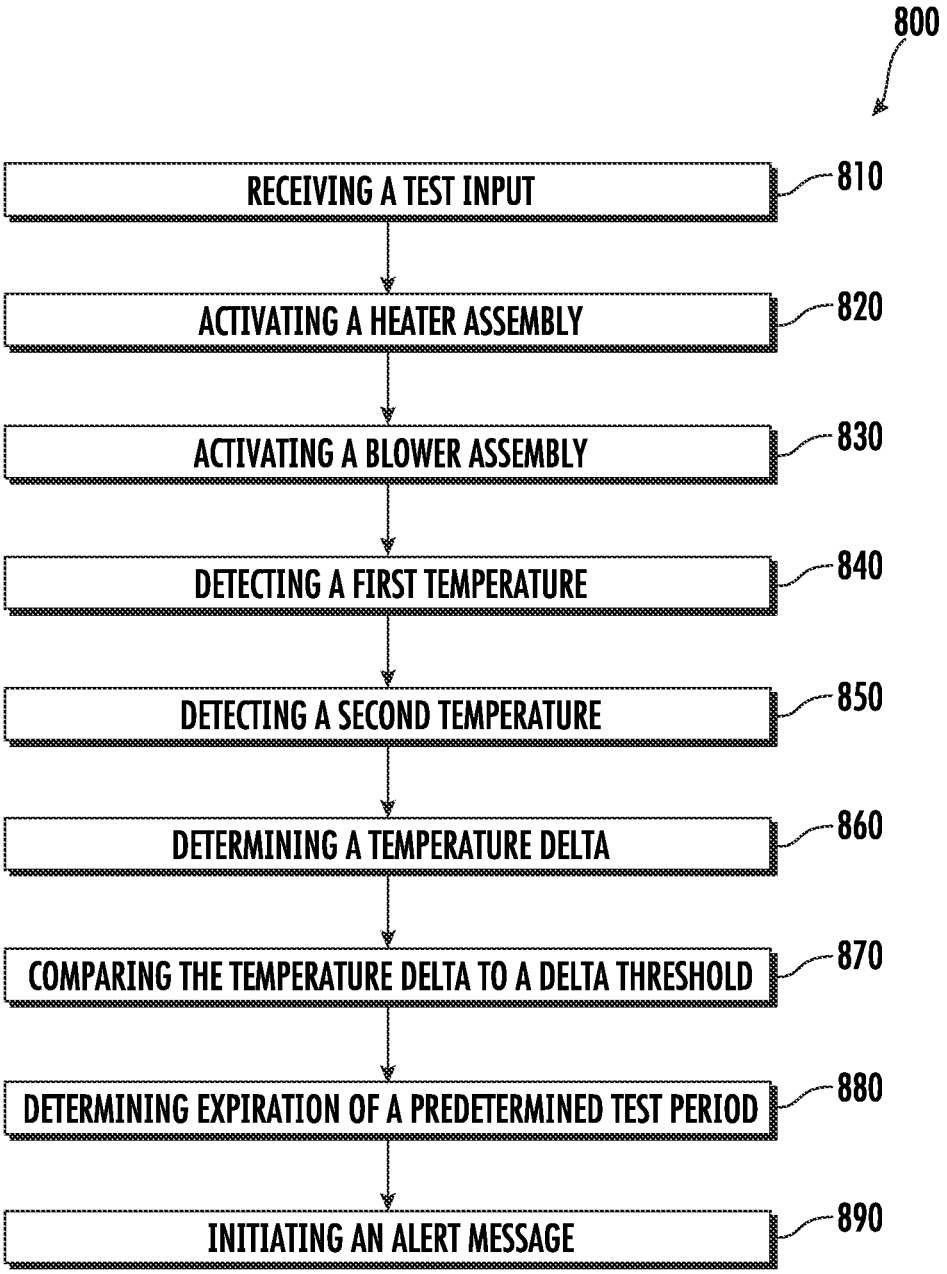
FIG. 8 provides a flow chart illustrating a method of operating a dryer appliance in accordance with exemplary embodiments of the present disclosure.

Turning now to FIG. 8, a flow diagram is provided to illustrate exemplary methods (e.g., method 800) according to exemplary embodiments of the present disclosure. Generally, the method 800 provide for detecting or addressing an obstruction (e.g., lint) within the exhaust path or ventilation conduit for a dryer appliance (e.g., appliance 10), such as might be provided for a test operation or cycle (e.g., separate or independent from an extending dry cycle). The method 800 can be performed, for instance, by the controller 82. For example, controller 82 may, as discussed, be in communication with the one or more temperature sensors 90, one or more motors (e.g., motor 31), heater assembly 40; and may send signals to and receive signals from temperature sensors 90, one or more motors (e.g., motor 31), and heater assembly 40. Controller 82 may further be in communication with other suitable components of the appliance 10 to facilitate operation of the appliance 10 generally. FIG. 8 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways (except as otherwise indicated) without deviating from the scope of the present disclosure.

Advantageously, methods (e.g., method 800) in accordance with the present disclosure may provide a way for a user to (e.g., consumer or serviceperson) to determine if a notably obstruction is present along the air path (e.g., at ventilation conduit) for air through a dryer appliance and drum. Notably, such methods may be performed without requiring the appliance to initiate or perform a typical dry cycle, which might require extended operation (e.g., extended activation of a heater assembly), rotation of the drum, detection of moisture, or articles within the chamber of the drum. Additionally or alternatively, such methods may provide for detecting obstructions without requiring reliance on (e.g., solely) rigid or expensive elements, such as a calibrated electromechanical thermostat.

At 810, the method 800 includes receiving a test input. Generally, the test input may indicate that a user (e.g., consumer or serviceperson) desires to initiate a test operation or cycle to determine if a notable obstruction within an air path through the appliance. For instance, input may be a signal received at the controller of the appliance (e.g., in response to the user selecting or engaging a button, switch, touchscreen icon, or other selector input of the control panel). Optionally, the test operation may be time limited. In some such embodiments, measuring or counting of a predetermined test period may begin with or in response to 810.

At 820, the method 800 includes activating a heater assembly. Specifically one or more heating elements (e.g., resistive elements, burners, etc.) may be directed to generate heat within the air path through drum (e.g., within the inlet duct). Activation of the heater assembly may be initiated in response to receiving the test input (e.g., at 810). In some embodiments, the heater assembly is activated at a set power output. For instance, the amount of fuel to a burner or, alternatively, electrical voltage or current to the heating elements at the start of 820 may be set or programmed in advance (e.g., to be consistent across discrete test operations). The set power output may be constant or, alternatively, variable (e.g., according to one or more predetermined conditions) throughout the test operation or predetermined test period.

In certain embodiments, activation of the heater assembly is further contingent or based upon an initial chamber assessment at 820. Such an assessment may account for temperature within the dryer appliance (e.g., within the chamber). For instance, the assessment may designate the dryer appliance as "HOT" or "COLD" (e.g., either HOT or COLD, such part of a binary designation) based on one or more factors. As an example, the assessment may evaluate or measure elapsed time since a previous cycle (e.g., most recent drying cycle or past test cycle). The elapsed time may be compared to a threshold time. An elapsed time at or below the threshold time may result in a HOT designation. Additionally or alternatively, an elapsed time above the threshold time may result in a COLD designation. As an additional or alternative example, the assessment may detect or measure temperature as a preliminary temperature prior to activating the heater assembly. The preliminary temperature may be compared to a preliminary threshold. A preliminary temperature above the preliminary threshold may result in a HOT designation. Additionally or alternatively, an elapsed time above the threshold time may result in a COLD designation.

In certain embodiment, a designation of COLD permits immediate activation of the heater assembly (e.g., following 810 and the assessment). In additional or alternative embodiments, a designation of HOT directs delayed activation of the heater assembly. For instance, in response to the HOT designation, the heater assembly may be held in an inactive state until a predetermined threshold temperature (e.g., the preliminary threshold) is met or a predetermined inactive delay period has elapsed (e.g., following the assessment). Optionally, the predetermined inactive delay period may be greater than 2 minutes, 5 minutes, or 8 minutes. Additionally or alternatively, the predetermined delay period may be less than 20 minutes, 15 minutes, or 12 minutes. For instance, the predetermined inactive delay period may be between 5 minutes and 10 minutes.

While the heater assembly is held in the inactive state, the blower assembly may be activated (e.g., at 830).

At 830, the method 800 includes activating a blower assembly. Thus, the motor of the blower may be activated to rotate the impeller or blower fan and initiate an air flow through the air path or drum of the dryer appliance. Activation of the blower assembly may be initiated in response to receiving the test input (e.g., at 810). Optionally, 830 may be simultaneous to 820. Alternatively, 830 may precede 820 (e.g., by a predetermined time period before initiation of 820 or in response to a HOT designation). Alternatively, 830 may be subsequent to 820 (e.g., by a predetermined time period for delay following initiation of 820). In some embodiments, the blower assembly is activated at a set power output. For instance, the electrical voltage or current to the motor of the blower at the start of 830 may be set or programmed in advance (e.g., to be consistent across discrete test operations). The set power output may be constant or, alternatively, variable (e.g., according to one or more predetermined conditions) throughout the test operation or predetermined test period. In additional or alternative embodiments, the blower assembly is activated at a set rotation speed (e.g., for the impeller or blower fan). The rotation speed may be constant or, alternatively, variable (e.g., according to one or more predetermined conditions) throughout the test operation or predetermined test period. Optionally, rotation of the drum may be prevented (e.g., while the blower assembly remains active).

At 840, the method 800 includes detecting a first temperature within the dryer appliance. Specifically, a first measurement for temperature may be taken along the air path for the drum in response to initiation of the test operation (e.g., following 820 or 830). As noted above, a temperature sensor (e.g., thermistor or thermocouple) may be mounted upstream from the drum or downstream from the heater assembly (e.g., at the drum inlet). The temperature measurement of 840 may be taken or detected at such a temperature sensor. In turn, the first temperature may be taken upstream from the drum. Along with being spatially limited (e.g., by the location or position of the temperature sensor), the first temperature may be temporally limited as a temperature measurement at a single point in time (e.g., during the test operation or the predetermined test period).

At 850, the method 800 includes detecting a second temperature within the dryer appliance. Specifically, a second measurement for temperature may be taken along the air path for the drum at a second moment (e.g., following the first moment of 840). In some embodiments, the second moment is temporally separated from the first moment by a set delay period (e.g., 5 seconds, 10 seconds, 30 seconds, or 1 minute). Thus, 850 may require or prompted by expiration of the set delay period following the first moment. Optionally, second temperature may be taken or detected at the same temperature sensor as the first temperature. For instance, the first temperature and the second temperature may both detected at the drum inlet.

As would be understood in light of the present disclosure, additional temperature measurements may be detected with the method 800 (e.g., similar to the first and second temperatures). Optionally, such temperature measurements may be obtained at regular intervals or at a set rate (e.g., corresponding to the set delay period). For instance, the method 800 may further include detecting a third temperature at a third moment following 850 (e.g., at the same temperature sensor or drum inlet as the first and second temperatures). Similar to the first and second moments, the third moment may be temporally separated from the second moment by the set delay period. Subsequently, further temperatures may also be detected (e.g., at further corresponding moments for at least a portion of the test operation or predetermined test period), as would be understood.

At 860, the method 800 includes determining a temperature delta. As described above, the temperature delta may generally provide a value of change or difference between two (e.g., temporally adjacent) temperatures. As an example, a first temperature delta may be determined as the difference between the second temperature and the first temperature. As another example, a second temperature delta may be determined as the difference between the third temperature and the second temperature. Further temperature deltas may further be determined, as would be understood.

In optional embodiments, the method 800 may include determining multiple discrete temperature deltas during the test operation or predetermined test period. For instance, as new temperatures are detected, new temperature deltas may be determined and collected or recorded (e.g., temporarily). The recorded temperature deltas may be filtered or compared. From such filtrations or comparisons, a maximum or peak delta (i.e., peak delta) may be established (e.g., for the test operation or the predetermined test period).

At 870, the method 800 includes comparing the temperature delta to a delta threshold. Generally, one or more delta thresholds may be provided as established or predetermined threshold values, as described above. Thus, in optional embodiments, the delta threshold includes a plurality of discrete delta thresholds. From the comparison of 870, it may be determined whether the temperature delta is greater than or, alternatively, less than or equal to one or more delta thresholds. Thus, 870 may include determining the temperature delta is greater than a delta threshold. Alternatively (e.g., based on the comparison), 870 may include determining the temperature delta is less than or equal to the delta.

The temperature delta for 870 may be established as be a single (e.g., unfiltered) temperature delta, such as that obtained at 860 (e.g., the first or second temperature delta). Additionally or alternatively, the temperature delta for 870 may be established as a filtered temperature delta obtained from multiple discrete temperature deltas (e.g., a maximum or peak delta). Optionally, multiple discrete temperature deltas (e.g., the first temperature delta and the second temperature delta) may be compared to the same temperature threshold(s), such as to determine the moment in which one or more temperature thresholds are exceeded.

At 880, the method 800 includes determining expiration of the test period. For instance, it may be determined that the predetermined test has expired following activating the heater assembly at 820 or receiving the test input at 810. In response to the test period expiring, the test operation may generally be halted. As an example, the heater assembly or blower assembly may be deactivated. As an additional or alternative example, collection of further temperature measurements may be halted.

At 890, the method 800 includes initiating an alert message. Generally, the alert message may be any suitable message for communicating the results of the one or more comparisons of a temperature delta to the one or more temperature thresholds. Thus, the alert message may be based on 870, such as to the comparison of the first temperature delta to the temperature threshold(s) or comparison of the second temperature delta to the temperature threshold(s) (e.g., separately from or in addition to the first temperature delta).

The alert message itself may be presented at the appliance or apart therefrom. As an example, the alert message may be a visual or audio message presented at the control panel (e.g., display). As an additional or alternative example, the alert message may be a visual or audio message presented at a remote device (e.g., phone, tablet, personal computer, etc.)

of a user, as would be understood. As would be understood, 890 may occur following (e.g., in response to) 880 or, alternatively, prior to 880 and the end of the test operation or period. The alert message may be based on or otherwise indicate if (and which) one or more thresholds are exceeded. If no temperature threshold is exceeded, the alert message may include text or other information to notify a user that the air path (e.g., at the ventilation conduit) is clear or unobstructed. In embodiments wherein a plurality of discrete delta thresholds are provided, the alert message may be contingent on which of the discrete delta thresholds are exceeded. For instance, in response to a temperature delta exceeding a relatively low (e.g., first threshold), the alert message may include text or other information to notify a user that the air path (e.g., at the ventilation conduit) is at risk for being blocked. Additionally or alternatively, in response to a temperature delta exceeding a relatively low (e.g., first threshold), the alert message may include text or other information to notify a user that the air path (e.g., at the ventilation conduit) is unsuitably blocked.

Separately from or in addition to the alert message, one or more functions of the dryer appliance may be modified in response to determining one or more threshold is exceeded. As an example, heat output or power to the heater assembly may be modified, such as to reduce the amount of heat that is permitted to emit from the heater assembly, in response to determination that one or more thresholds has been exceeded. Optionally, activation of the heater assembly may be halted or prevented (e.g., until an obstruction is cleared).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet;

a drum mounted within the cabinet, the drum defining a drying chamber;

a heater assembly in upstream fluid communication with the drying chamber to heat air thereto;

a temperature sensor in upstream fluid communication with the drying chamber to detect a temperature of air thereto; and a controller in operable communication with the heater assembly and the temperature sensor, the controller being configured to initiate a test cycle, the test cycle comprising directing an initial chamber assessment of the drying chamber following a previous cycle, activating the heater assembly based on the initial chamber assessment, detecting a first temperature upstream of the drum at a first moment following activating the heater assembly, detecting a second temperature upstream of the drum at a second moment following the first moment, determining a temperature delta as a difference between the second temperature and the first temperature, comparing the temperature delta to a delta threshold, and initiating an alert message based on comparing the temperature delta to the delta threshold.

2. The dryer appliance of claim 1, wherein the test cycle further comprises determining expiration of a predetermined test period following activating the heater assembly, and deactivating the heater assembly in response to determining expiration of the predetermined test period.

3. The dryer appliance of claim 1, wherein the temperature delta is a first temperature delta, wherein the test cycle further comprises detecting a third temperature at a third moment following the second moment, determining a second temperature delta as a difference between the third temperature and the second temperature, and comparing the second temperature delta to the delta threshold, and wherein initiating the alert message is further based on comparing the second temperature delta to the delta threshold.

4. The dryer appliance of claim 1, wherein the first temperature is detected at the temperature sensor, wherein the second temperature is detected at the temperature sensor, and wherein the second moment is temporally separated from the first moment by a set delay period.

5. The dryer appliance of claim 1, wherein the heater assembly is activated at a set power output.

6. The dryer appliance of claim 1, wherein comparing the temperature delta to the delta threshold comprises determining the temperature delta is greater than the delta threshold.

7. The dryer appliance of claim 6, wherein the delta threshold comprises a plurality of discrete delta thresholds, and wherein the alert message is contingent on which delta thresholds of the plurality of discrete delta thresholds are exceeded.

8. The dryer appliance of claim 1, wherein comparing the temperature delta to the delta threshold comprises determining the temperature delta is less than or equal to the delta threshold.

9. The dryer appliance of claim 1, further comprising a blower assembly downstream from the heater assembly to motivate air through the drying chamber, wherein the test cycle further comprises activating the blower assembly prior to detecting the first temperature.

10. A method of operating a dryer appliance comprising a drum defining a drying chamber and a heater assembly in upstream fluid communication with the drying chamber, the method comprising:

directing an initial chamber assessment of the drying chamber following a previous cycle;

activating the heater assembly based on the initial chamber assessment;

detecting a first temperature upstream of the drum at a first moment following activating the heater assembly;

detecting a second temperature upstream of the drum at a second moment following the first moment;

determining a temperature delta as a difference between the second temperature and the first temperature;

comparing the temperature delta to a delta threshold; and initiating an alert message based on comparing the temperature delta to the delta threshold.

11. The method of claim 10, further comprising:

determining expiration of a predetermined test period following activating the heater assembly; and deactivating the heater assembly in response to determining expiration of the predetermined test period.

12. The method of claim 10, further comprising:

detecting a third temperature at a third moment following the second moment;

determining a second temperature delta as a difference between the third temperature and the second temperature; and comparing the second temperature delta to the delta threshold, wherein initiating the alert message is further based on comparing the second temperature delta to the delta threshold.

13. The method of claim 10, wherein the first temperature is detected at a temperature sensor upstream from the drying chamber, wherein the second temperature is detected at the temperature sensor, and wherein the second moment is temporally separated from the first moment by a set delay period.

14. The method of claim 10, wherein the heater assembly is activated at a set power output.

15. The method of claim 10, wherein comparing the temperature delta to the delta threshold comprises determining the temperature delta is greater than the delta threshold.

16. The method of claim 15, wherein the delta threshold comprises a plurality of discrete delta thresholds, and wherein the alert message is contingent on which delta thresholds of the plurality of discrete delta thresholds are exceeded.

17. The method of claim 10, wherein comparing the temperature delta to the delta threshold comprises determining the temperature delta is less than or equal to the delta threshold.

18. The method of claim 10, wherein the dryer appliance further comprises a blower assembly downstream from the heater assembly, wherein the method further comprises:

activating the blower assembly prior to detecting the first temperature.

19. A dryer appliance, comprising:

a cabinet;

a drum mounted within the cabinet, the drum defining a drying chamber;

a heater assembly in upstream fluid communication with the drying chamber to heat air thereto;

a temperature sensor in upstream fluid communication with the drying chamber to detect a temperature of air thereto;

a blower assembly downstream from the heater assembly to motivate air through the drying chamber; and a controller in operable communication with the heater assembly, the blower assembly, and the temperature sensor, the controller being configured to initiate a test cycle, the test cycle comprising directing an initial chamber assessment of the drying chamber, directing the initial chamber assessment comprising measuring a temperature within the drying chamber or an elapsed time from a previous cycle, activating the heater assembly based on the initial chamber assessment, activating the blower assembly independent of the initial chamber assessment, detecting a first temperature upstream of the drum at a first moment following activating the heater assembly and activating the blower assembly, detecting a second temperature upstream of the drum at a second moment following the first moment, determining a temperature delta as a difference between the second temperature and the first temperature, comparing the temperature delta to a delta threshold, initiating an alert message based on comparing the temperature delta to the delta threshold, determining expiration of a predetermined test period following activating the heater assembly, and deactivating the heater assembly in response to determining expiration of the predetermined test period.

20. The dryer appliance of claim 19, wherein directing the initial chamber assessment comprises determining the measured temperature within the drying chamber is above a preliminary temperature threshold or determining the elapsed time is below a threshold time, wherein the test cycle further comprises holding the heater assembly in an inactive state prior to activating the heater assembly in response to determining the measured temperature within the drying chamber is above the preliminary temperature threshold or determining the measured elapsed time is below the threshold time, wherein activating the heater assembly is contingent on a predetermined temperature threshold being met within the drying chamber or a predetermined delay period elapsing, and wherein activating the blower assembly is initiated while holding the heater assembly in the inactive state.

* * * * *